United States Patent [19]

Wendt

[11] 4,024,590

[45] May 24, 1977

[54] PATIENT SANITARY CARE UNIT

[75] Inventor: David W. Wendt, Monona, Wis.

[73] Assignee: Will Ross, Inc., Milwaukee, Wis.

[22] Filed: Sept. 29, 1975

[21] Appl. No.: 617,285

[52] U.S. Cl. ..... 4/166; D23/48; 4/167; 220/23.83; 312/227; 220/94 A

[51] Int. Cl.[2] ..... A47K 1/04

[58] Field of Search ..... 220/23.83, 23.86, 94 A; 4/166, 167, 168, 169, 170, 159; 312/227

[56] References Cited

UNITED STATES PATENTS

| | | | |
|---|---|---|---|
| 2,717,505 | 9/1955 | Andersson | 220/23.83 |
| 2,944,694 | 7/1960 | Kinsey | 220/23.83 |
| 3,591,871 | 7/1971 | Segal | D23/48 |
| 3,611,450 | 10/1971 | Bost | 220/20 |
| 3,720,963 | 3/1973 | Zakaski | 4/167 |
| 3,775,779 | 12/1973 | Kohler | 4/166 |

*Primary Examiner*—George E. Lowrance
*Attorney, Agent, or Firm*—Quarles & Brady

[57] ABSTRACT

A patient sanitary care unit comprises a wash basin with opposite handles and a removable emesis basin and soap dish having handles that overlay respective wash basin handles so that all three components can be easily grasped separately or together. The emesis basin is supported by tongues that extend downwardly from its handle through slots in the wash basin handle, and a top flange that overlays a top flange of the wash basin. The soap dish is similarly mounted, but it does not have overlaying flanges and the tongues are provided with fingers that hook under the wash basin handle to provide a cantilever support.

1 Claim, 5 Drawing Figures

Fig.1
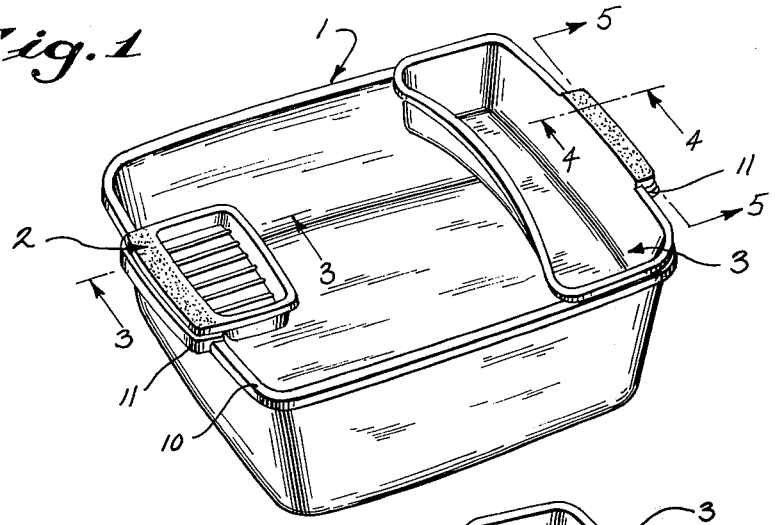
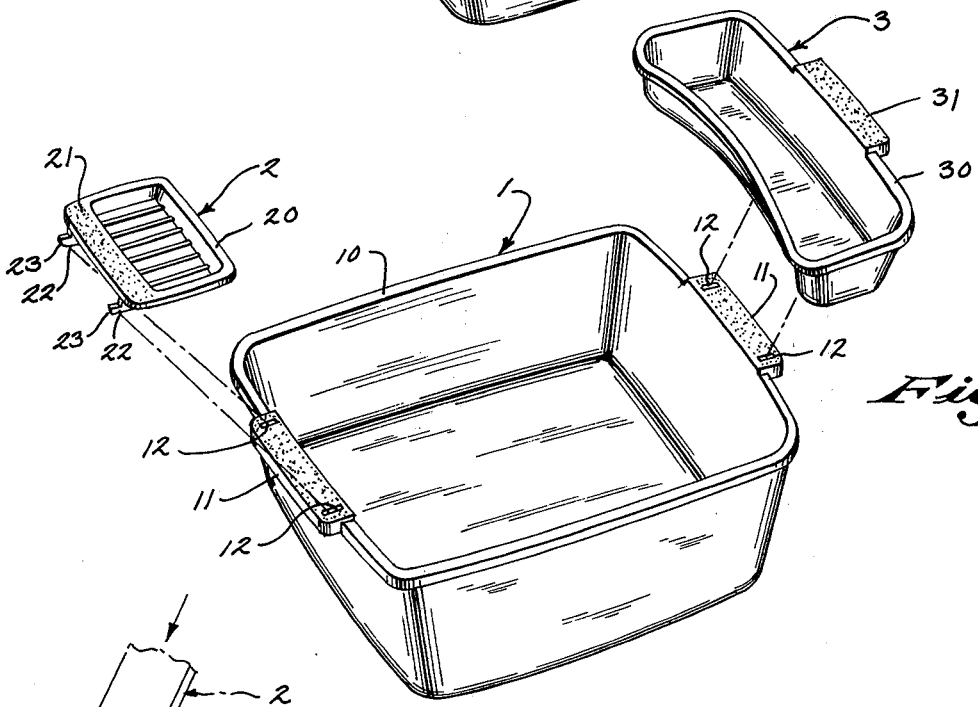
Fig.2
Fig.3
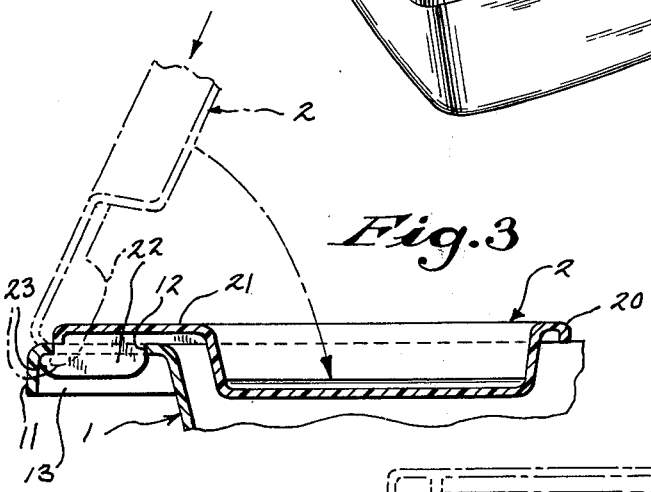
Fig.4
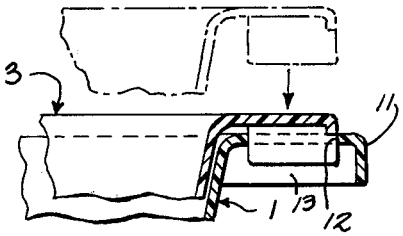
Fig.5
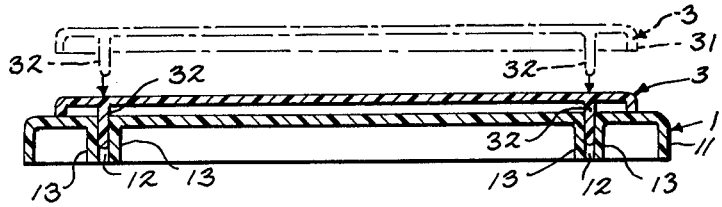

PATIENT SANITARY CARE UNIT

BACKGROUND OF THE INVENTION

Wash basins, emesis basins and soap dishes are commonly supplied to hospital patients, but they are often supplied as individual units and storage and handling of the separate components can be troublesome. There are units in which an emesis basin and soap dish can be connected to a wash basin, but they are not fully satisfactory from the standpoint of either the patient or the nurse. One major problem for combination units is providing an arrangement which allows the user to effectively grasp either the individual components or the assembled unit. Another problem has been divising suitable means to hold the emesis basin and soap dish on the wash basin securely, while still allowing for easy removal.

SUMMARY OF THE INVENTION

It is the general object of this invention to provide a patient sanitary care unit including a wash basin and subsidiary tray components like an emesis basin and soap dish, which unit is compact and efficient, easy to store and handle, and relatively inexpensive. One specific object is to provide a unit in which handles on the subsidiary components overlay handles on the wash basin so that all the components can be grasped securely at the same time and each can be handled separately. Another specific object is to provide a cantilever mounting for a smaller component like a soap dish utilizing tongues on the soap dish handle that extend through slots on the wash basin handle and are provided with fingers that hook under the wash basin handle. Another specific object is to provide a similar mounting for larger components like an emesis basin, but one in which there are no fingers and support is provided by a top flange that overlays the top flange of the wash basin. Other objects and advantages will appear from the description to follow.

BRIEF DESCRIPTION OF THE DRAWING

FIG. 1 is a view in perspective showing a preferred embodiment of the invention with the several components in assembled position;

FIG. 2 is an exploded view in perspective of the unit of FIG. 1 showing the components disassembled;

FIG. 3 is a fragmentary view in cross section through the plane 3—3 shown in FIG. 1 and showing an alternative position of the soap dish in broken lines;

FIG. 4 is a fragmentary view in cross section through the plane 4—4 shown in FIG. 1 with an alternative position of the emesis basin being shown in broken lines; and FIG. 5 is a fragmentary view in cross section through the plane 5—5 shown in FIG. 1 with an alternative position of the emesis basin shown in broken lines.

DESCRIPTION OF THE PREFERRED EMBODIMENT

The patient sanitary care unit shown in FIGS. 1 and 2 includes a wash basin 1 and two subsidiary components — a soap dish 2 and an emesis basin 3, all three items preferably being molded from a suitable plastic material. The wash basin 1 in the preferred embodiment has a generally rectangular configuration with a closed bottom and an open top surrounded by a laterally extending top flange 10. On opposite shorter ends of the basin 1 there are laterally outwardly extending handles 11, 11 which are seen most clearly in FIG. 2. These may be of any suitable configuration; in the preferred embodiment they are generally rectangular and flat with downturned edges for added strength, and their upper surfaces are embossed or roughened to provide a slip-proof grip. Each handle 11 is provided with a pair of parallel slots 12 that extend laterally outwardly from the associated end of the wash basin 1, the slots 12 being located near the ends of their respective handles 11. As seen in FIGS. 3, 4, and 5 the undersides of the handles 11 are preferably provided with reinforcing ribs 13 on each side of each slot 12.

As seen in FIGS. 1 and 2, the soap dish 2 is of generally conventional rectangular tray-like configuration with a ribbed bottom and a perimetrical flange 20 extending about both short edges and one long edge. On the remaining long edge there is a laterally extending handle 21 which is similar in configuration to the handles 11 but slightly smaller. The underside of the handle 21 is provided with a pair of downwardly depending tongues 22 which are slightly smaller in cross section than the slots 12 and are provided at their outer ends with outwardly extending finger-like projections 23. As can be seen in FIG. 3, the soap dish 2 is attached to or removed from the wash basin 1 by tipping it upwardly to the angled position shown in broken lines so that the tongues 22 and fingers 23 can be inserted into or removed from the corresponding slots 12. When the dish 2 is being attached, it is then simply allowed to pivot downwardly to the position shown in full lines in FIG. 3, in which the fingers 23 will be hooked under the corresponding handle 11 to provide a cantilever support. This cantilever support is particularly suitable for a soap dish or any similar item that is not required to support substantial weight and that is not large enough to extend to the sides of the wash basin 1.

The emesis basin 3 is generally rectangular but one of its long side walls is concave to give it a conventional configuration for such items. The length of the basin 3 in only slightly less than the width of the basin 1. The upper edge of the emesis basin 3 is provided with a perimetrical top flange 30, and there is a handle 31 on the outer long side that is shaped similarly but somewhat smaller than the corresponding wash basin handle 11. As can be seen in FIGS. 4 and 5, the underside of the handle 31 is provided with a pair of rectangular tongues that are slightly smaller than and fit through the slots 12. The emesis basin 3 is attached to and removed from the wash basin 1 simply by moving it vertically to insert or remove the tongues 32 from the slots 12. When it is in place, the portions of the top flange 30 at the short ends of the emesis basin 3 and on the opposite sides of the handle 31 overlay and rest on corresponding portions of the top flange 10 to support the basin 3. This manner of support, as opposed to the cantilever support of the soap dish 2, is particularly suitable for the emesis basis 3 because it is required to support substantially more weight.

When the components are assembled as seen in FIG. 1, with the handles of the components overlying the handles of the wash basin and the body of the components extending over the interior of the basin, the patient or nurse can grasp and move all three simply by grasping the handles 11 and the overlying handles 21, 31; gripping the overlying handles from above and below also insures that the soap dish 2 and emesis basin 3 will not move with respect to the wash basin 1. The soap dish and/or the emesis basin 3 may easily be removed as noted above, and the handles 21, 31 allow each of them to be grasped easily and securely. When the soap dish 2 and emesis basin 3 are removed, the handles 11 remain on the wash basin 1 and allow it to be grasped and manipulated.

The construction shown and described provides an extremely compact and efficient, but relatively inexpensive, unit the components of which can be handled easily separately or as a unit. The means by which the soap dish 2 and emesis basin 3 are removably attached provide for secure attachment without requiring complicated moldings or openings in the side walls of the wash basin 1. While the preferred embodiment offers all of the noted advantages, however, it will be apparent that variations might be made without departure from the spirit of the invention. Obviously, the sizes and configurations of the components could be varied. It is not necessary that the unit include only an emesis basin and soap dish and other subsidiary tray components might be substituted; the invention might be used with any sort of tray-like component, and the term "tray" as used in the appended claims is intended to cover emesis basins, soap dished, and all similar or related items. If desired, a cantilever mounting like that used for the soap dish 2 could be used for the emesis basin 3. In view of the noted and other possible modifications, it is not intended that the invention be limited by the showing or description herein, or in any other manner, except insofar as specifically required.

I claim:

1. A combination wash basin, emesis basin and soap tray assembly which is easy to store and carry and which can be separated so that the wash basin, emesis basin and soap tray can be used independently, which assembly comprises:

a. a generally rectangular wash basin having a closed bottom and an open top, said wash basin being provided with a laterally extending flange about said top, which flange is interrupted by laterally outwardly extending enlarged handles at opposite ends of said wash basin, said handles having a pair of parallel slots and reinforcing ribs on the underside of the handle on each side of each slot;

b. a generally rectangular emesis basin having a closed bottom, an open top, and one side wall that is concave and one that is straight, said emesis basin being of a length which is only slightly less than the internal width of the wash basin, said emesis basin having an outwardly extending flange extending around the perimeter of said open top, said flange along the straight side wall being interrupted by a single enlarged handle the underside of which is provided with a pair of downwardly extending tongues, said emesis basin being positioned within the wash basin so that the enlarged handle overlies one handle of the wash basin with the tongues positioned within the slots in the wash basin handle and the flange of the emesis basin along all but the concave side wall rests upon the open top of the wash basin thus supporting the emesis basin within the wash basin; and c. a relatively small generally rectangular soap tray having a closed bottom and an open top, one side wall of said tray being provided with an outwardly extending handle the underside of which is provided with a pair of downwardly extending elongated tongues each of which are provided with an outwardly extending fingerlike projection, said soap tray being positioned within the wash basin so that the tray handle overlies the other handle of the wash basin and the elongated tongues with the fingerlike projections enter into and cooperate with the slots in the other handle of the wash basin to secure the tray onto the wash basin.

* * * * *